US005379863A

United States Patent [19]

Sugawara et al.

[11] Patent Number: 5,379,863

[45] Date of Patent: Jan. 10, 1995

[54] CRANE

[75] Inventors: Tomokatsu Sugawara; Koji Jinno, both of Komaki, Japan

[73] Assignee: Daifuku Co., Ltd., Osaka, Japan

[21] Appl. No.: 125,916

[22] Filed: Sep. 23, 1993

[30] Foreign Application Priority Data

Jan. 26, 1993 [JP] Japan ..... 5-010360
May 31, 1993 [JP] Japan ..... 5-127667
Jun. 30, 1993 [JP] Japan ..... 5-160776

[51] Int. Cl.[6] ..... B66B 11/04
[52] U.S. Cl. ..... 187/233; 414/282
[58] Field of Search ..... 187/22, 20, 94, 9 R, 187/23, 1 R; 414/281, 282, 663

[56] References Cited

U.S. PATENT DOCUMENTS 379,260 10/1893 Pifre ..... 187/20
657,380 9/1900 Baldwin ..... 187/22
684,390 10/1901 Venn ..... 187/94
921,646 5/1909 Larson ..... 187/20
2,169,440 8/1939 Weiss ..... 187/9 R
3,592,348 7/1971 Atwater ..... 214/16.4
3,840,131 10/1974 Castaldi ..... 214/16.4
3,934,741 1/1976 Wentz ..... 414/663
4,222,140 9/1980 Olewinski et al. ..... 187/94
4,358,239 11/1982 Dechantsreiter ..... 414/661
5,207,555 5/1993 Shirai ..... 414/282

FOREIGN PATENT DOCUMENTS 2223561 3/1972 Germany .
50-35513 6/1975 Japan .
63-218405 9/1988 Japan .
1092110 7/1989 Japan .
1092108 11/1989 Japan .
2-182604 4/1990 Japan .
2182604 4/1990 Japan .
182663 7/1990 Japan ..... 187/20
3018598 4/1991 Japan .
3056399 11/1991 Japan .
4260586 9/1992 Japan .
8300353 1/1983 Netherlands .

*Primary Examiner*—Kenneth W. Noland
*Attorney, Agent, or Firm*—Barnes, Kisselle, Raisch, Choate, Whittemore & Hulbert

[57] ABSTRACT

A vertical run drive unit 30 for driving an upward and downward movable carriage 16 mounted to one side of a support post 12A comprises a pair of sheaves 36, 40 arranged in vertically spaced apart relation, and a vertical run drive mechanism 33 interlockingly connected to one of the sheaves 36. There are provided wires 45A, 45B, 45C, 45D which are each passed over the upper sheave 20 and trained about the lower sheave 36 from opposite directions, the wires 45A, 45B, 45C, 45D being connected at one end to the carriage 16 and at the other end to counterweights 51A, 51B. A load applied to both ends of each wire can be caused to act toward tensioning the wire relative to the sheaves, thereby to exert a strong force of friction on the wire, so that sufficient force of movement can be obtained. The counterweights need not be large-sized to provide a strong frictional force and can be made relatively low in height, it being thus possible to set a longer stroke for the carriage.

21 Claims, 19 Drawing Sheets

CRANE

FIELD OF THE INVENTION

The present invention relates to a handling apparatus employed in an automataic warehousing facility, for example, which is of the type having a handling carriage adapted for upward and downward movement through wires.

BACKGROUND OF THE INVENTION

Hithereto, apparatuses of this kind have been known, as typically described in, for example, Japanese Utility Model Publication No. 50-35513, which teaches a hoisting device for an automatic warehousing crane. In this prior art arrangement, the automatic warehousing crane comprises an upper structure having guide rollers, a travelling lower structure, an upward and downward movable transfer carriage, a control board, a drive mechanism, and a hoisting device body for driving the upward and downward movable transfer carriage.

The hoisting device body includes an electric motor mounted on a frame, an upper rope pulley carried by the frame at a midportion thereof and geared to the electric motor, and a pair of lower rope pulleys, right and left, carried by the frame at a level lower than the upper rope pulley, the upper rope pulley and the pair of lower rope pulleys being interlockingly connected by gears.

For wire run, the arrangement in this prior art is such that two wire ropes put on the upper rope pulley are extended downward to engage the two lower rope pulleys from the inner side and are then turned outward to extend upward until they engage a sheave which in turn guide the pair of ropes downward, the pair of ropes being connected at one end to a counterweight via an equalizer, the other ends of the ropes being connected to the upward and downward movable transfer carriage in a longitudinally spaced apart relation.

In this proir art arrangement, the upper rope pulley is driven forward or reverse by the motor to rotate the two lower rope pulleys in a same direction thereby to move the wire ropes forward or reverse for upward or downward movement of the upward and downward movable transfer carriage. The use of wire ropes is intended to provide for weight reduction as compared with the use of chains to enable the use of an electric motor of a smaller capacity, and to decrease noise.

According to the above described arrangement of the prior art apparatus, a load applied to both ends of each wire rope acts toward relaxing wire rope winding about the rope pulley, that is, toward relieving frictional force on the rope pulley. Therefore, the wire ropes cannot have sufficient moving force applied thereto.

This prior art arrangement, which includes a pair of lower rope pulleys and gears, involves a relatively large number of parts and is rather complicated. As such, in some situation, the crane may be too large in width to enter the path for its run. Further, since the rope pulleys have their respective shafts supported at both ends on a box-like frame, it is rather difficult to pass the wire rope between the rope pulleys in the stage of assembly work.

Another problem relates to the fact that there is provided only one counterweight. When a larger-size (or heavier) counterweight is employed so as to reduce the capacity of the electric motor, the counterweight, normally disposed within a post, has an increased height and, accordingly, a stroke of counterweight movement, or a stroke of vertical movement of the upward and downward movable transfer carriage, is made shorter.

The fact that the electric motor, heavy in weight, is mounted on the frame results in the drive portion being tall in height, which means that the drive portion is positionally unstable. Further, mounting of the motor at such a high location is inconvenient from the standpoints of wiring work and maintenance.

Another problem is that the direction of wire rope winding about the upper rope pulley is opposite to the direction of wire winding about the lower rope pulleys. This means that bending force acts on the wire ropes alternately in opposite directions, which results in decreasing the service life of the wire ropes.

The counterweight, located externally of the upper structure, is liable to run out as it is moved upward and downward. Provision of guide means for the counterweight may add to the complicatedness of the arrangement.

When the wires have been stretched in course of use, the stretch will easily affect the transfer carriage in such a way as to tilt the transfer carriage. Such wire stretching must be adjusted at wire ends by operating an equalizer, but it is no easy job to effect such adjustment.

As another arrangement of the type has been proposed a travelling crane for warehousing use as typically described in Japanese Laid-Open Patent Application No. 2-182604. This prior art crane comprises a lower frame, a horizontal run drive unit and a vertical run drive unit arranged on one-end side of the lower frame as viewed in the direction of movement thereof (or on the outer position side), a pair of support posts extending upward from the lower frame, an upward and downward movable carriage mounted between the support posts, and a box-like crane control unit provided on the other end side of the lower frame as viewed in the direction of movement thereof (on the home position side).

The horizontal run drive unit comprises a frame member mounted to one lower end of the lower frame, a drive wheel carried by the frame member, and a reduction gear and a braked motor, both geared to the drive wheel, which are mounted on one side of the frame member as viewed widthwise of the crane.

The vertical run drive unit comprises a frame member mounted to one upper end of the lower frame, a toothed drive wheel carried by the frame member and having its shaft supported on both sides, a motor located above the toothed drive wheel and geared to the shaft via a reduction gear located on the other side of the crane widthwise thereof, and a chain held in engagement with the toothed drive wheel and interlockingly connected to the upward and downward movable carriage. In this prior art arrangement, by motor-driving the toothed drive wheel forward and reverse it is possible to drive the chain forward and reverse thereby to move the carriage upward and downward.

According to the above described arrangement of the prior art crane, the shaft on which the toothed drive wheel is mounted is supported on a frame member. This makes it difficult to pass the chain beneath the toothed drive chain at the stage of assembly work. That also makes it difficult to perform maintenance and inspection. Another problem is that a crane control unit for controlling the horizontal and vertical run drive units is disposed at a location most remote from those units. This makes it difficult to carry out wiring arrangement between the control unit and the drive units. Further, the toothed drive wheel is exposed at sides and top thereof. This poses a problem from the standpoint of safety, because other objects or an operator may have a chance of easy contact with them.

DISCLOSURE OF THE INVENTION

The present invention is intended to solve the foregoing problems. Therefore, it is an object of the invention to provide a handling apparatus which has a wire arrangement capable of producing sufficient force of movement. It is another object of the invention to increase the weight of a counterweight without reducing the stroke of vertical movement of a carriage. It is a further object of the invention to provide a handling apparatus which permits easy arrangement of wire into position and easy maintenance of the wire arrangement. It is another object of the invention to provide a handling apparatus which has vertical and horizontal run drive units arranged compactly and in a well balanced manner relative to the force of wire suspension. It is another object of the invention to provide a handling apparatus which enables easy inter-unit wire connection. It is still another object of the invention to provide a handling apparatus which affords easy covering of an exposed drive of a vertical run drive unit.

In order to accomplish the above objects, according to the present invention there is provided a handling apparatus comprising a travelling body including a lower frame, a support post extending upwardly from the lower frame and an upper frame mounted on the top of the support post, an upward and downward movable carriage mounted on one side of the post as viewed in the direction of movement of the travelling body, a vertical run drive unit mounted on the other side of the post for driving the carriage to move upward and downward, the vertical run drive unit including a pair of sheaves arranged in vertically spaced relation and a vertical run drive mechanism interlockingly connected to one of the sheaves, and a wire passed over the upper one of the sheaves and trained about the lower sheave from opposite directions, the wire being connected at one end to the carriage, the other end of the wire being connected to a counterweight.

According to such arrangement, the handling apparatus performs inward and outward delivery of load relative to a target storage portion of a rack through a combination of driving the travelling body to run and actuating the vertical run drive unit to move the carriage upward and downward. The carriage can be moved upward and downward by transmitting a forward or reverse rotation of the carriage to one of the sheaves, which sheave acts as a drive sheave, thereby to apply a force of movement to the wire trained about the drive sheave.

The wire, after being passed over the upper sheave, is trained about the lower sheave from opposite directions. Accordingly, a load applied to opposite ends of the wire acts toward tightening wire engagement with the sheaves. Thus, a strong frictional force is applied to the wire to provide sufficient force of movement. In this way, the wire has sufficient force of movement under the effect of strong force of friction. Therefore, the counterweight need not be large-sized to provide a strong frictional force and can be reduced in height to provide a longer stroke for the carriage. Wire movement drives the carriage to move upward and downward. At this time, the counterweight is moved in a reverse vertical direction.

In one embodiment of the invention, the wire passed over the upper sheave and trained about the lower sheave from opposite directions is provided in two sets, the two sets of wires being respectively passed at both ends over guide sheaves provided on the upper frame and then connected at one end to the carriage in spaced relation in the direction of movement of the travelling body, the other ends of the wires being connected to a common counterweight. According to this arrangement, as the two sets of wires move in a direction, the common counterweight tends to be moved in the opposite vertical direction.

The handling apparatus of the invention, in its another form, comprises a pair of support posts, front and rear, extending upward from a lower frame, a carriage vertically movably mounted between the support posts, and two sets of wires passed over an upper sheave of a vertical run drive unit and trained about a lower sheave from opposite directions, the sets of wires being passed over a guide sheave on the upper frame and connected at one end to the carriage in spaced apart relation, the other ends of the wires being separately connected to a pair of counterweights.

According to such arrangement, since the counterweights are disposed in spaced apart relation, they need not be large-sized but, when put together, provide a larger weight. Thus, it is possible to reduce the capacity of the drive mechanism.

In a preferred embodiment of the invention, the vertical run drive unit comprises a pair of vertically spaced sheaves, and a vertical run drive mechanisms located outwardly of the sheaves as viewed in the direction of movement of the travelling body, one of the sheaves being interlockingly connected to the vertical run drive mechanism. According to this arrangement, it is possible to reduce the distance between the two sheaves, and to mount the vertical run drive mechanism without increasing the width of the travelling body. In another embodiment, the vertical run drive unit comprises a frame member provided on the lower frame side, a pair of sheaves, upper and lower, mounted to the frame member in a cantilever fashion, and a vertical run drive mechanism interlockingly connected to one of the sheaves. According to this arrangement, wire placement between the two sheaves can be easily and quickly made via an open space available on the opposite side from the frame member.

In another embodiment of the invention, the wire is trained about the pair of vertically spaced sheaves in a given direction of winding. According to this arrangement. The wire, as it moves between the sheaves, is always subject to same directional bending. In another form of the apparatus, the support post is of a hollow construction and has a counterweight vertically movably disposed therein. Thus, the counterweight is guided by the support post for upward and downward movement without swinging.

In a further embodiment of the invention, four wires are trained about the lower sheave from opposite directions, the wires being passed at both ends over a guide sheave on the upper frame, first and second ones of the wires being connected at one end to one side of the carriage, third and fourth ones of the wires being connected at one end to the other side of the carriage, the first and fourth wires being connected at the other end to a counterweight disposed within one support post, and the second and third wires being connected at the other end to a countereweight disposed within the other support post. According to this arrangement, the force of movement of respective wires can be uniformly transmitted to both sides of the carriage and to the two conterweights.

In another preferred embodiment of the invention, the vertical run drive unit comprises a vertical run drive mechanism and a pair of sheaves vertically spaced from each other in relation to the vertical run drive mechanism, one of the sheaves being interlockingly connected to the vertical run drive mechanism. According to this arrangement, a space between the two sheaves can be utilized in mounting the vertical run drive mechanism. When the wire is placed in a cross pattern on the pair of vertically spaced sheaves, the length of the wire in engagement with the sheaves can be increased.

In another embodiment of the invention, at least one of the pair of vertically spaced sheaves is movable toward and away from the other sheave. In this case, such movement of one sheave toward and away from the other sheave enables an elongation with the wire to be absorbed by a change in the length of the wire between the two sheaves.

According to a further aspect of the invention, the vertical run drive unit includes a drive sheave disposed in a cantilever fashion in a widthwise center portion of the travelling body, and a vertical run drive mechanism interlockingly connected to the drive sheave and disposed at one side of the travelling body as viewed widthwise thereof, and a horizontal run drive unit for driving the travelling body is disposed at the other side of the travelling body and in opposed relation to the vertical run drive unit, a wire passed over the drive sheave being connected at one end to the carriage, the other end of the wire being connected to a counter weight.

According to such arrangement of the invention, operations including wire placement over the sheaves, as required in the process of assembly work, and maintenance and inspection with respect to such wire engagement portions, can be easily and quickly performed via an open space on the opposite side from the cantilever side (frame member side). Further, when the travelling body tends to incline toward one side (the drive mechanism side of the vertical run drive unit) under the suspending force of the wire, such force can be partially absorbed by a load on the horizontal drive unit side, the travelling body being thus prevented from tilting.

In one embodiment of the invention, a pair of sheaves, upper and lower, are arranged in a cantilever fashion at a location central widthwise of the travelling body, and the vertical run drive mechanism is interlockingly connected to one of the shieves, with a wire being trained between the two sheaves. According to this arrangement, the wire is trained between the two sheaves and, therefore, loads applied on both ends of the wire are caused to act toward tightening the engagement of the wire with the sheaves, whereby a strong force of friction is applied to the wire to provide sufficient force of movement.

In another embodiment of the invention, the vertical run drive mechanism and the horizontal run drive mechanism are longitudinally arranged. According to this arrangement, the handling apparatus can be mounted in position in a compact and well balanced manner, without any increase in its width and horizontal length. Therefore, even where the passage between racks is narrow, the handling apparatus can be readily put in use, and any dead space external of rack ends can be reasonably reduced. Thus, good improvement can be obtained in space utilization efficiency for automatic warehousing.

In another form of the handling apparatus of the invention, a power control unit for horizontal and vertical run is disposed adjacent to the horizontal run drive unit. In still another form, there is mounted a power supply unit on the lower frame at a location beneath the power control unit for horizontal and vertical run. According to such arrangement, any dead space located before or behind the horizontal run drive unit, or therebelow, can be utilized in mounting the horizontal and vertical run power control unit and/or power supply unit without increasing the width or length of the handling apparatus. The load of such power control unit or power supply unit serves to absorb a part of a force applied to the travelling body under the suspension force of the wire which tends to tilt the travelling body toward one side.

In another aspect of the invention, on the other side of the support post there are disposed a vertical run drive unit for driving the carriage to move upward and downward and a horizontal run drive unit for driving the travelling body to run, the vertical run drive unit including a drive sheave disposed in a widthwise center portion of the travelling body, with a power control unit for horizontal and vertical run mounted to the travelling body at such a position as to cover the drive sheave from a side.

According to such arrangement, the power control unit can easily cover the drive sheave, exposed as such, from one side to prevent the drive sheave to be contacted by any other member or an operator. Thus, the apparatus, as a whole, can be constructed in a safety-oriented manner. Disposition of the power control unit adjacent to the horizontal and vertical run drive units permits easy wire connection between the units, with a shorter wiring range.

DESCRIPTION OF THE EMBODIMENTS

A first embodiment of the invention will now be described with reference to FIGS. 1 through 9.

Figure 1:
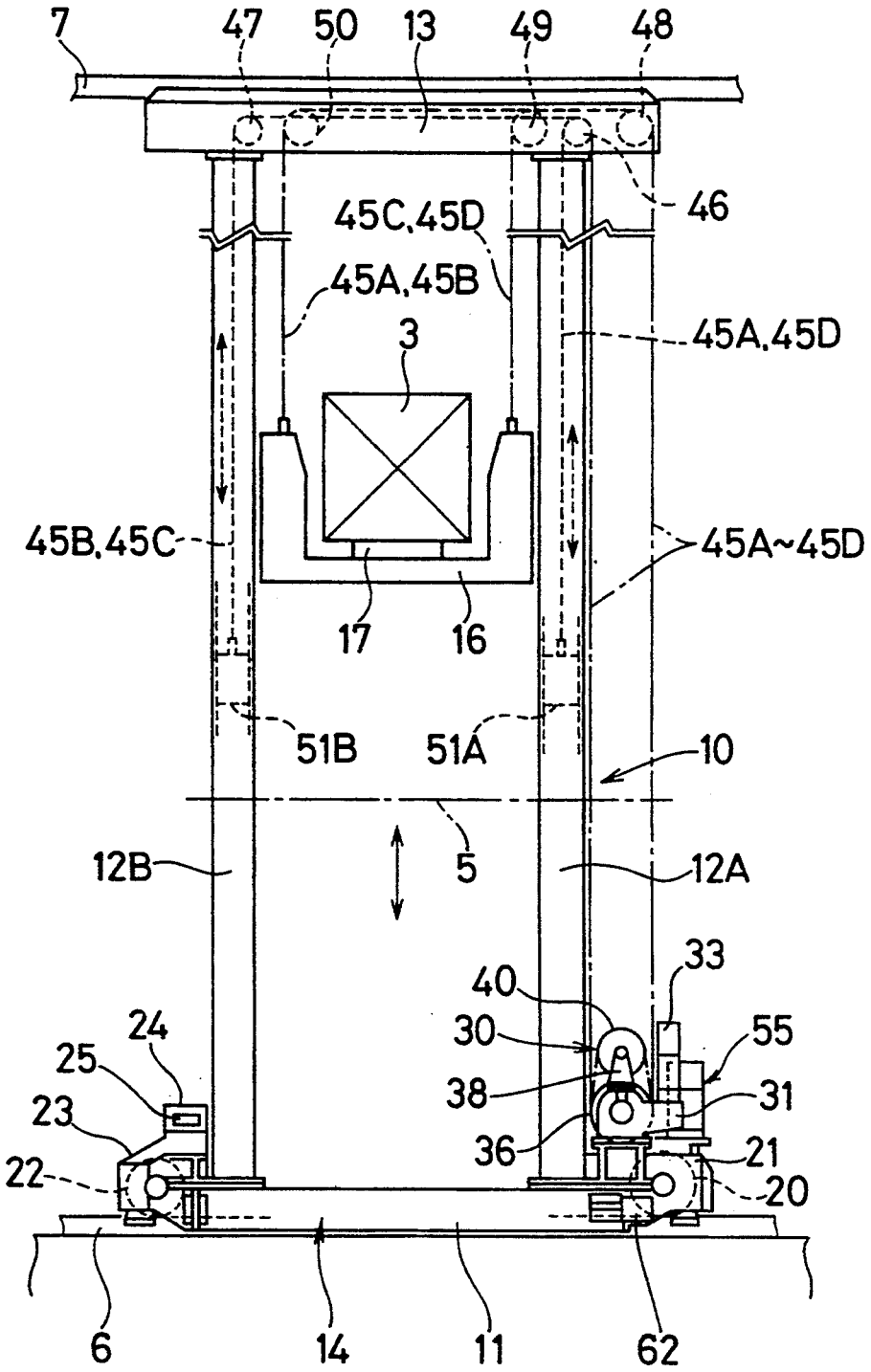
FIG. 1 is a partially cutaway side view of a handling apparatus representing a first embodiment of the invention.
Figure 2:
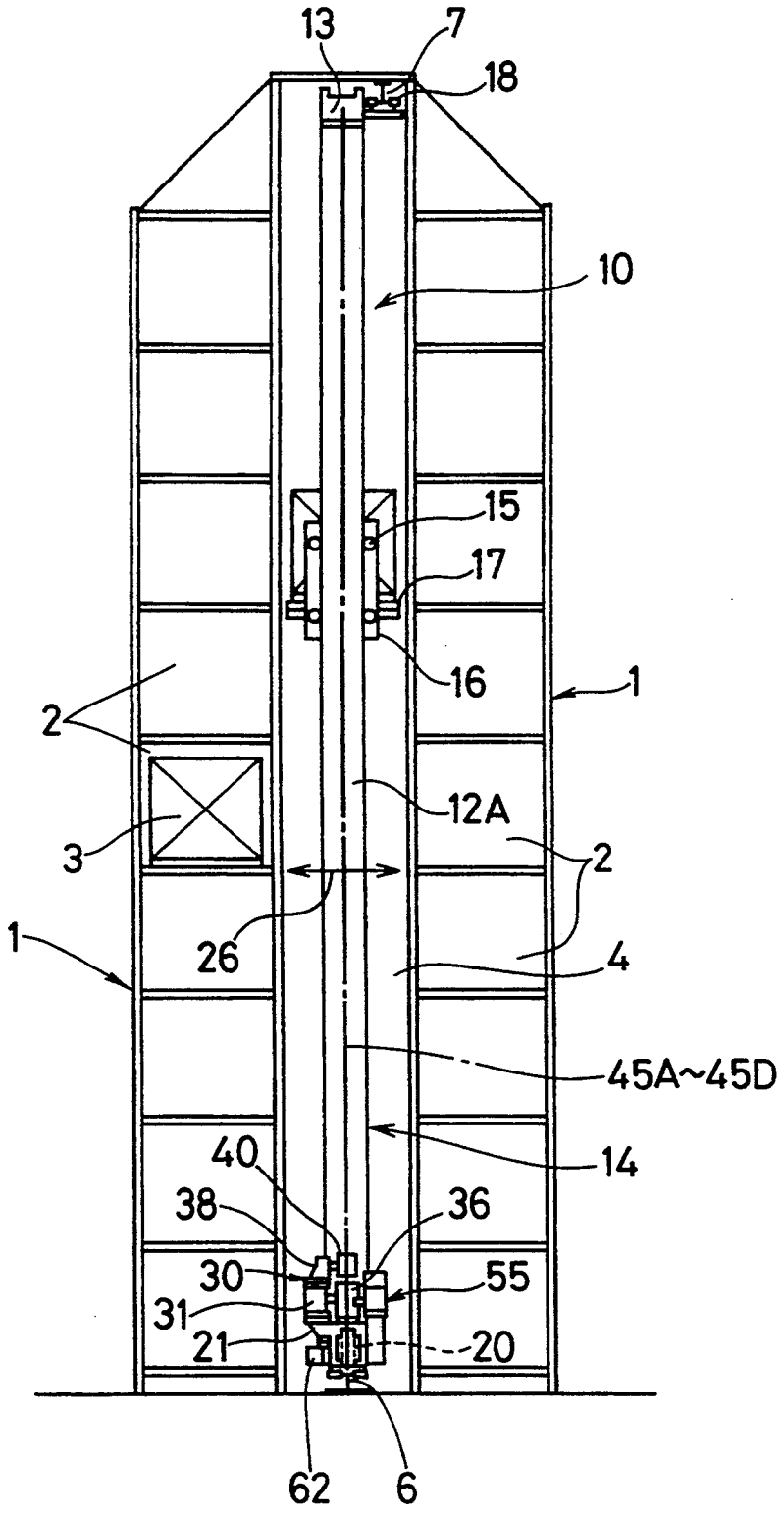
FIG. 2 is a front view of an automatic warehouse using the handling apparatus.
Figure 3:
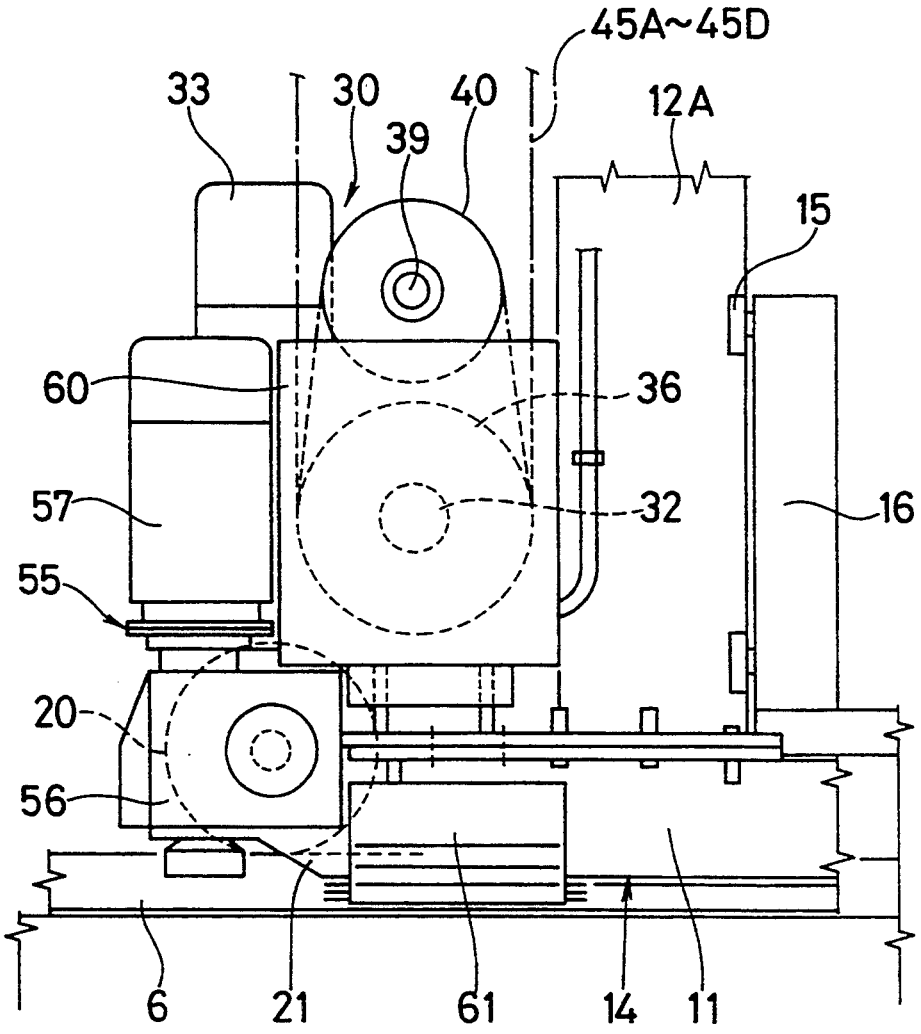
FIG. 3 is a side view of a portion of the handling apparatus in which a power control unit is disposed.
Figure 4:
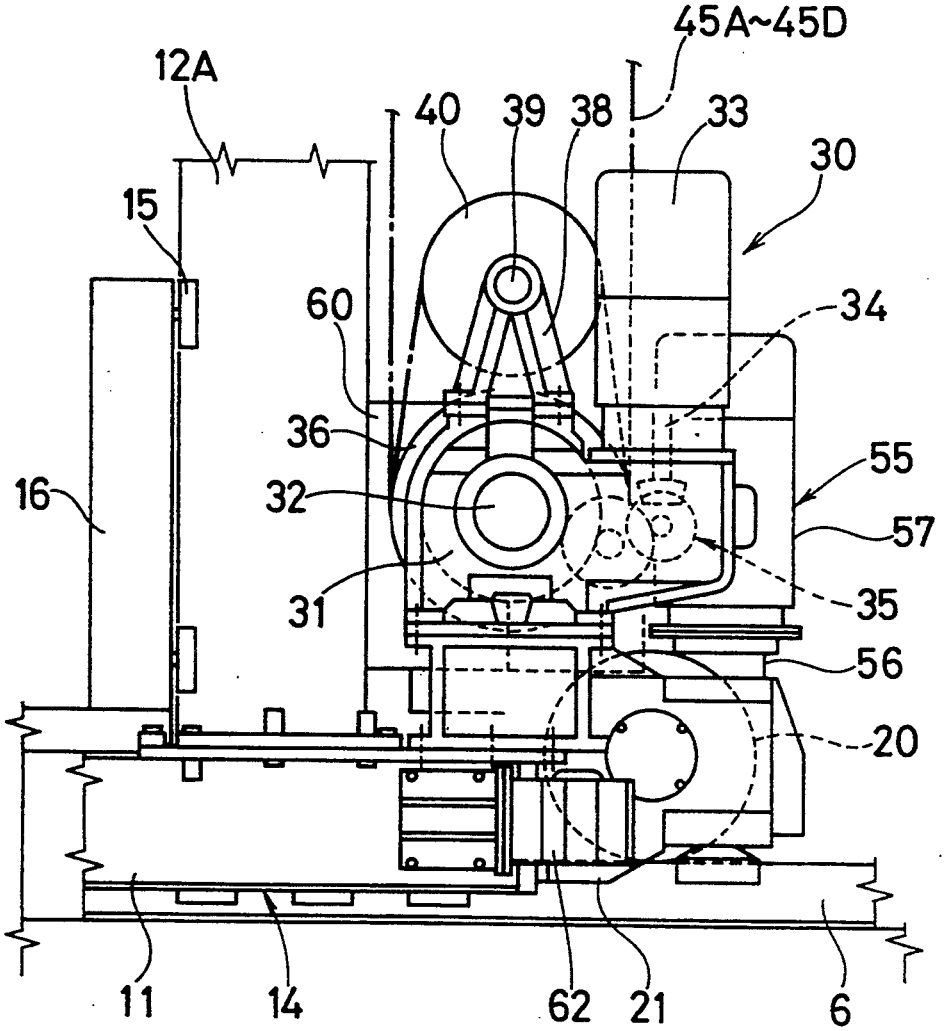
FIG. 4 is a side view of a portion of the handling apparatus in which a vertical run drive unit is disposed.

In FIGS. 1 and 2, a framework-configured rack 1 has pluralities of storage portions 2 defined in vertical and horizontal directions, each of the storage portions 2 being adapted to support a load B (directly or via a pallet) through cross-arm means. Racks 1 are arranged in parallel across a passage 4. In the passage 4 is placed a handling apparatus 10 which is movable on a predetermined track 5 provided in front of the racks 1.

The handling apparatus 10 includes a travelling body 14 comprising a lower frame 11, a pair of support posts 12A, 12B made of square pipes (round pipes) which extends upward from the lower frame 11 and is spaced from each other in the longitudinal direction (direction of movement of the apparatus), and an upper frame 13 interconnecting the upper ends of the support posts 12A, 12B. Disposed between the two support posts 2A and 12B is a carriage 16 which is guided for upward and downward movement via guide rollers 15 along opposite sides of the support posts 12A, 12B which serve as guide surfaces. On the carriage 16 there is provided a handling element (fork member) 17 which is retractable relative to a storage portion 2 or the like. The upper frame 13 has a guide device 18 guided by a ceiling rail 7.

At one end (on the outer position side) of the lower frame 11, as viewed longitudinally thereof, there is carried through a support frame 21 a drive wheel 20 movable in rolling contact with a floor rail 6, and at the other end (on the home position side at which a load handling station is located) of the lower frame 11 there is carried a driven wheel 22 through a support frame 21. On this support frame 23 at the other end of the lower frame 11 there is disposed a control unit 24 for controlling operative portions of the handling apparatus 10, with its control face 25 positioned to look sideways. At the one end of the lower frame 11, or on the other side of one support frame 12A, there is disposed a vertical run drive unit 30 geared to the carriage 16, through the intermediary of the support frame 21.

As FIGS. 1 to 6 show, the vertical run drive unit 30 includes a case member 31 which extends longitudinally from one end side of the support frame 21 (one end side of the travelling body 14 as viewed in the widthwise direction 26 thereof). A vertically extending vertical run drive mechanism (motor and the like) 33 is fixed on the top of the case member 31, its output shaft 32 extending downwardly into the case member 31.

A transversely extending drive shaft 34 is disposed on the other side of the case member 31, the drive shaft 34 being interlockingly connected to the output shaft 32 via a reduction gear (comprising bevel gear and spur gear mechanisms) 35 disposed within the case member 31. The drive shaft 34 projects toward the other side in a cantilever fashion, with a drive sheave 36 connected to the projection. On the top of the transmission case 31 there is fixed a bearing device 38 which supports a transversely extending rotary shaft 39 in a cantilever fashion, with a follower sheave (idle sheave) 40 fixed to a projection thereof. Thus, the two sheaves 36, 40 are centrally located widthwise 26 of the travelling body 14 and arranged in vertically spaced relation. The transmission case 31 and the bearing device 38 constitute a frame member on the lower frame 11.

Figure 5:
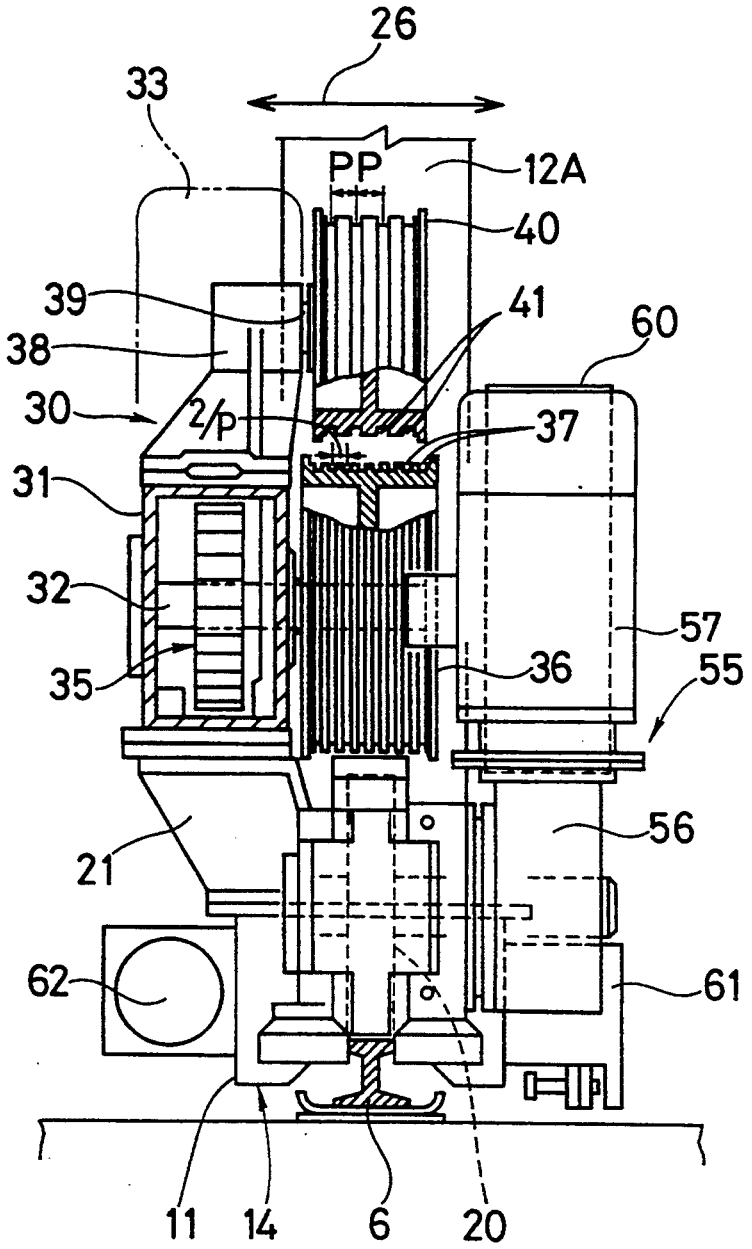
FIG. 5 is a partially cutaway front view of the portion in which the vertical run drive unit is disposed.
Figure 6:
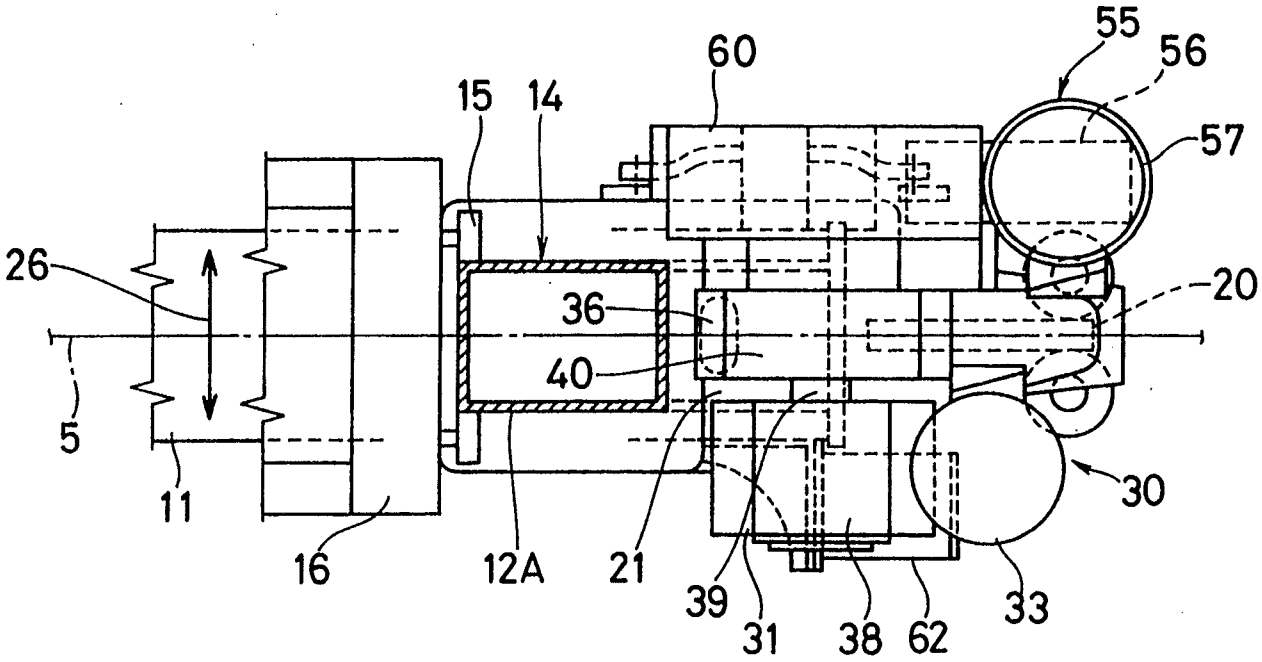
FIG. 6 is a plan view of the portion in which the power control unit is disposed.
Figure 8:
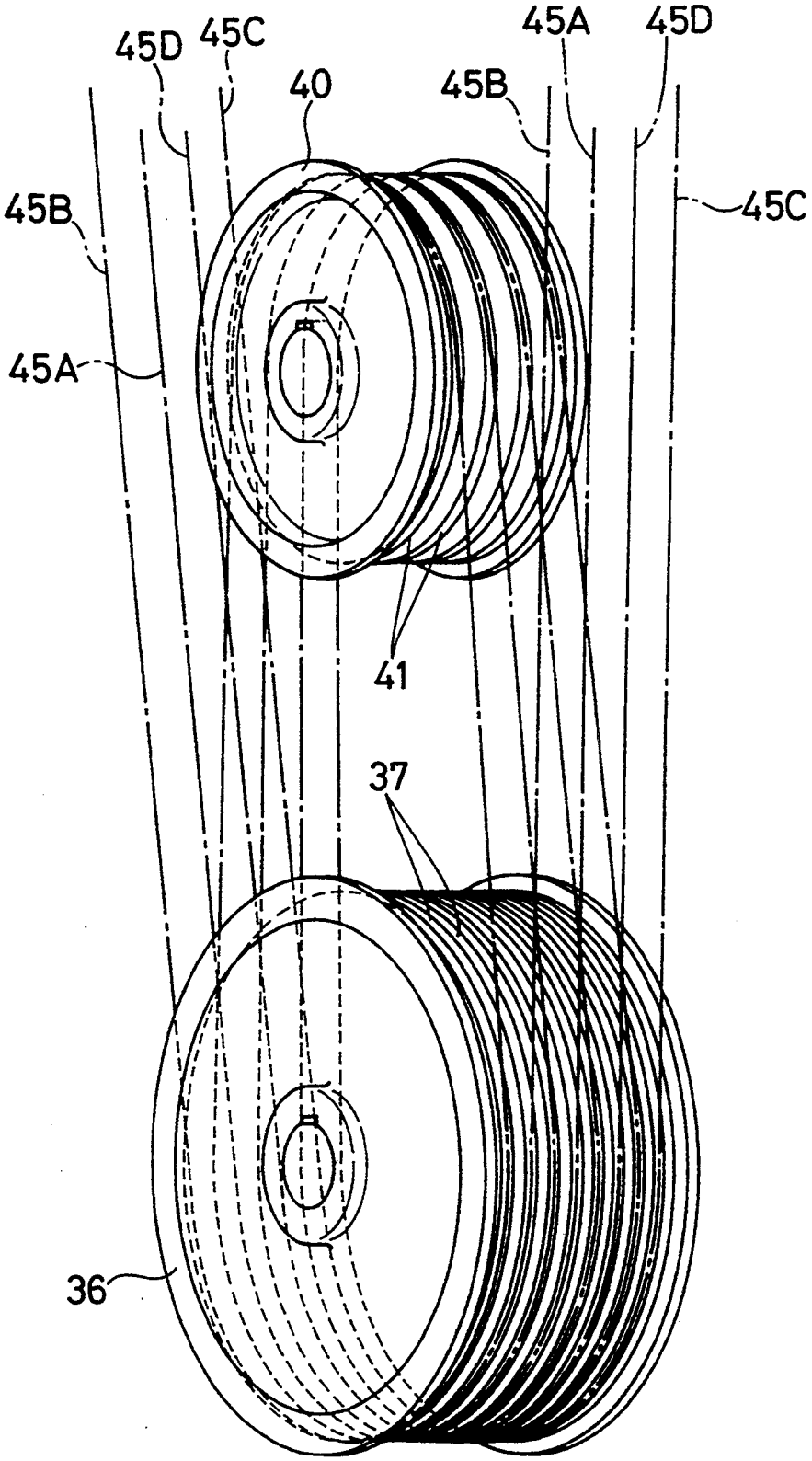
FIG. 8 is a schematic perspective view showing wires arranged in position at the vertical run drive unit portion.

As FIGS. 5 and 8 show, the drive sheave 38 is formed at a predetermined pitch P with annular guide grooves 37 at 8 locations (plural locations), and the follower sheave 40 is formed with annular wire guide grooves 41 at 4 locations (plural locations) at twice the predetermined pitch P or pitch 2P.

The wire guide grooves 41 of the follower sheave 40 are individually engaged by wires (4 in all) from above, namely, a first wire 45A, a second wire 45B, a third wire 45C, and a fourth wire 45D. These wires 45A to 45D extend downward at both ends to come into engagement with the drive sheave 36 from opposite directions, in a constant direction of winding.

The wires 45A to 45D, at the other end side, are put in engagement with the wire guide grooves 37 of the drive sheave 36 from one side to the other and then drawn upward, while at the one side the wires are put in engagement with the wire guide grooves 37 from the other side to the one side and then drawn upward. In that case, the wires 25A to 25D are trained about the drive sheave 36 by utilizing exclusive wire guide grooves 37. At the stage of assembly work, wire mounting can be easily performed from an open space available on the side opposite to the case member supporting the sheaves 36, 40 and/or to the bearing device 38. Maintenance and inspection can also be easily performed from this open space.

Figure 7:
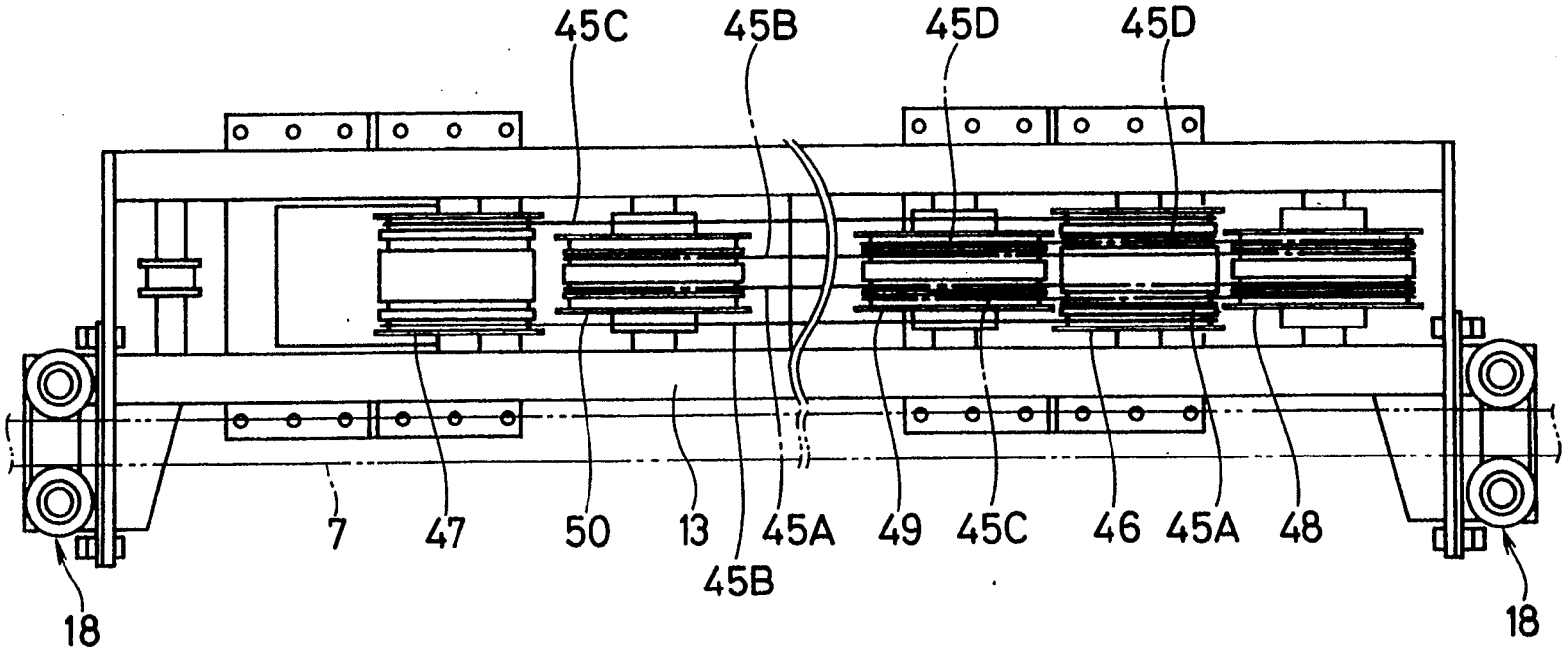
FIG. 7 is a plan view of an upper frame portion of the apparatus.
Figure 9:
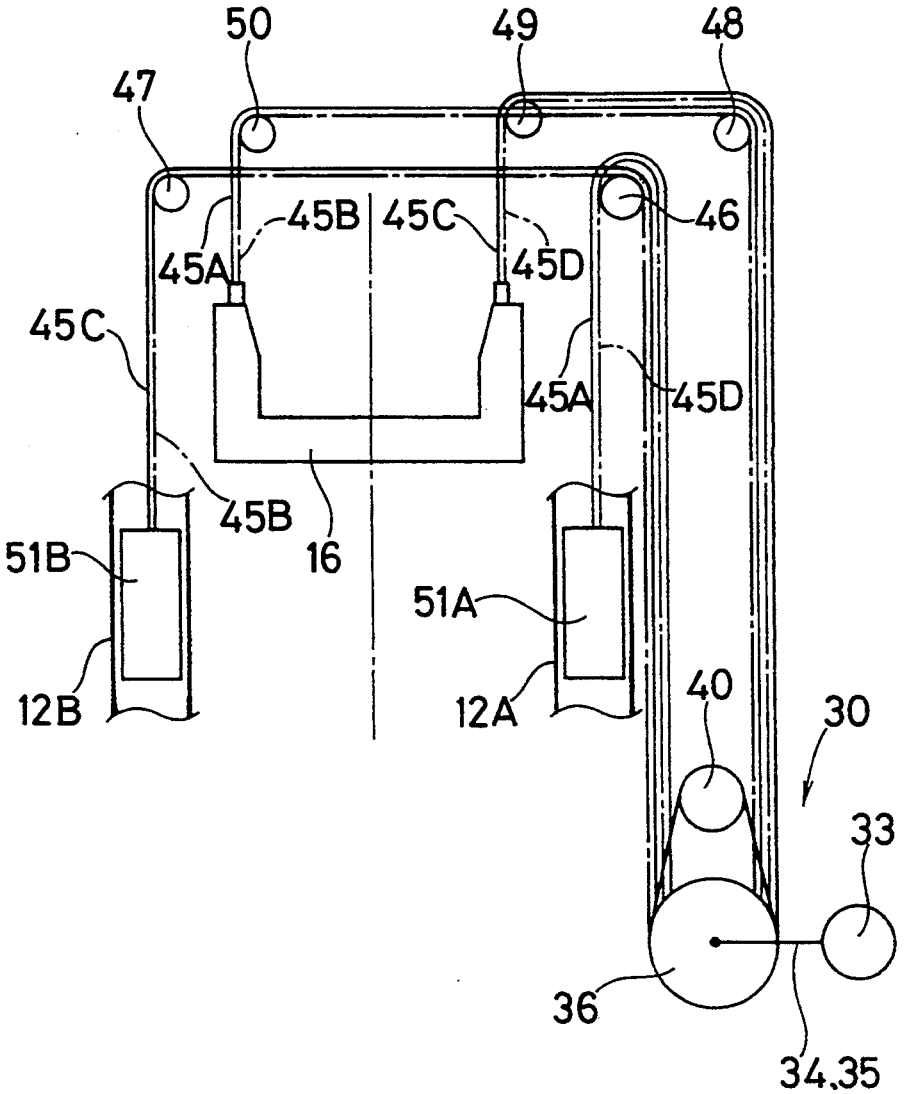
FIG. 9 is a schematic side view showing the condition of the wires in their run.

For wire run with respect to wires 45A to 45D, as FIGS. 1, 7 and 9 show, other end side portions, for example, of the four wires positioned on the post 12A side are first passed over a first guide sheave 26, and then two of the four, i.e., first wire 45A and fourth wire 25, are drawn downward into the support post 12A for being connected to a counterweight 51A vertically movably disposed therein. The remaining two wires, i.e., second wire 45B and third wire 45C, are first passed over a first guide sheave 46 and then over a second guide sheave 47, and then drawn downward into the post 12B for being connected to a counterweight 51B vertically movably disposed therein.

The one end side portions of the four wires located away from the support post 12 are passed over a third guide sheave 48 disposed on the upper frame 13 and then extend longitudinally of the upper frame 13 therewithin until they are trained about a fourth guide sheave 49 and about a fifth guide sheave 50, whereby they are separated into two groups of two wires each in longitudinally spaced apart relation. That is, the wires are separated into one group consisting of third wire 45C and fourth wire 45D and another group consisting of first wire 45A and second wire 45B. Thus separated groups of wires extend downward, then the third wire 45C and fourth wire 45D are connected at one end to the top of the carriage 16 at one side thereof, and the first wire 45A and second wire 45B are connected at one end to the other side of the carriage 16.

As FIGS. 1 to 6 show, a horizontal run drive unit 55 for the travelling body 14 is vertically disposed in opposed relation to the vertical run drive mechanism 33 on the other side of the travelling body 14 widthwise 26 thereof. More specifically, a reduction gear 56 geared to the drive wheel 20 is fixed to the surface of the support frame 21 at the other side thereof and, on the reduction gear 56, there is fixedly mounted upright a horizontal run drive mechanism (a flange-type braked motor and the like) 57 which has a downwardly extending output shaft geared to a reduction gear 56.

At a position adjacent the horizontal run drive unit 55 on the support post 12A side there is disposed a power control unit 60 having a travel power control function with respect to the handling apparatus 10 and a vertical run power control function with respect to the carriage 16 combined in a panel form. The power control unit 60 is rectangular box-shaped and has a thinner portion oriented in the widthwise direction 26 which is so positioned and configured as to completely cover the drive sheave 36 from a side, the power drive unit 60 being fixed to the support frame 21.

A power supply unit 61 is disposed beneath the power control unit 60 and on the other side of the lower frame 11. The power supply unit 61 may be provided integrally with the power control unit 60. A stopper device 62 is provided at a location opposite to the power supply unit 61 at one side of the lower frame 11 and also at a location at the other end of the lower frame 11 on the other side thereof which stands in symmetrical relation with the first mentioned location.

In the above described embodiment, the power control unit 60 can be mounted in position by utilizing a dead space created in front of the horizontal run drive unit 55, without involving any increase in the width and/or length of the handling apparatus 10. The power control unit 60 can cover the drive sheave 36 in exposed condition from the other side thereof. Also, the power supply unit 61 can be mounted in position by utilizing a dead space created below the power control unit 60, without involving any increase in the width and/or length of the handling apparatus 10.

By disposing the power control unit 60 adjacent the horizontal run drive unit 55 and/or vertical run drive unit 30 in this way it is possible to easily carry out wire arrangement between these units, with the distance of wiring reduced accordingly.

The handling apparatus 10, constructed as above described, can deliver load 3 to and from a target storage portion of each rack 1 by performing a combination of movements, such as driving the travelling body 14 via the horizontal run drive unit 55 to run on the predetermined track 5, driving the carriage 16 via the vertical run drive unit 30 to move upward and downward, and causing the handling element 17 to fork, in accordance with an operating command given through the power control unit 60.

The above described vertical movement of the carriage 16 is performed by transmitting forward and reverse rotation of the vertical run drive mechanism 33 to the output shaft 32, reduction gear 35, and drive shaft 34 to turn the drive sheave 36 forward and reverse, thereby to apply a force of movement to the group of wires 45A to 45D trained about the drive sheave 36.

Since wires 45A to 45D are passed over the follower sheave 40 positioned above and then trained about the drive sheave 36 from opposite directions, loads of the carriage 16 and counterweights 51A, 51B applied on respective both ends of wires 45A to 45B tend to act toward tightening the winding of wires 45A to 45D about the two sheaves 36, 40, and thus wires 45A to 45B are subjected to a strong frictional force, so that sufficient force of movement can be obtained.

Such movement of wires 45A to 45D on one side is guided through the third to fifth guide sheaves 48, 49 50 and this causes the carriage 16 to move upward and downward. At this time, movement of wires 45A to 45D on the other side is guided by the first and second guide sheaves 46, 47 whereupon the counterweights 51A, 51B in the posts 12A, 12B are actuated to vertically move in a direction opposite to the carriage 16. Thus, the vertical movement of the carriage 16 is smoothly performed in such a condition that any overload of the drive mechanism 33 is reasonably alleviated.

The travelling body 14 tends to be tilted toward one side (drive mechanism 33 side of the vertical run drive unit 30) under the force of suspension of the wires 45A to 45D, but such tilting force is partially absorbed by the load on the side of the horizontal run drive unit 55 disposed at an opposite side. Again, such tilting force can be partially absorbed by the load of the power control unit 60 and/or of the power supply unit 61.

According to this first embodiment, wires 45A to 45D are provided with sufficient force of movement under the effect of strong frictional force applied thereto as above described. Therefore, the counterweights 51A, 51B need not be larger-sized so as to provide strong frictional force. The fact that counterweights 51A, 51B are separately disposed in longitudinally spaced apart relation makes it possible to provide an increased total weight so that the capacity of the drive mechanism (motor) 34 can be reduced.

In the above described first embodiment, wires 45A to 45D are trained between a pair of sheaves 36, upper and lower. In another form, as set forth in claims 19 and 24, wires 45A to 45D may be trained about one drive sheave 36. While in the foregoing first embodiment, four wires 45A to 45D are employed, in another form, as set forth in each of claims other than claim 15, two fires may be used, in which case on the upper frame 13 side the wires may be separated in longitudinally spaced relation.

In the foregoing first embodiment, the horizontal run power unit 60 and the vertical run power unit 61 are arranged in position by utilizing a dead space created in front of the horizontal run drive unit 55, and the power supply unit 63 is positioned by utilizing a dead space created beneath the two power units 60, 61. In another form, as claimed in claims 1, 10 and 19, these units 60, 61, 63 may be disposed adjacent a side of the lower frame 11, or the power supply unit 63 may be disposed adjacent a side of other unit.

As in the foregoing first embodiment, the travelling body 14, carriage 16, power supply for the handling element 17, and controls for various operative portions of the handling apparatus 10 may be constructed as units 60, 24. As a result, a control panel can be dispensed with, space saving can be achieved, and the lower frame 11 can be reduced in size. Thus, any dead space at a terminal stop position on the predetermined track 5 can be reduced and warehousing efficiency can be improved.

Further, unitization of parts provides for size reduction and weight reduction and enables easy mounting of parts on the lower frame 11 without requiring the use of a crane or the like, it being thus possible to achieve improved efficiency of assembly work. Limitations as to site for mounting are eliminated and, accordingly, the power control unit 60 can be mounted close to both the vertical run drive mechanism 33 and the horizontal run drive mechanism 57. Operation checking with respect to the vertical run drive mechanism 33 and horizontal run drive mechanism 57 can be carried out by only one operator, which results in improved operating efficiency. The trouble of pulling around a power cable via a control board as often required in the past is eliminated, which results in cost saving with respect to cables and wiring. Further, in connection with the unitization of power unit, the power control unit 60 can be standardized by standardizing the motor capacity for the vertical and horizontal run drive mechanisms 33 and 57. Positional arrangement for them can be predetermined. Thus, design time can be reduced, and delivery time can also be reduced.

In the foregoing first embodiment, the travelling body 14 comprises a pair of support posts 12A, 12B, front and rear, and an upper frame 13 interconnecting upper ends of the posts 12A, 12B. In another form, as set forth in any one of claims 1, 19 and 24, the handling apparatus 10 may be of the type having only one support post and having no upper frame. In the foregoing first embodiment, a cap for checking and repair may be vertically movably provided externally of the other post 12B located opposite the vertical run drive unit 30.

Figure 10:
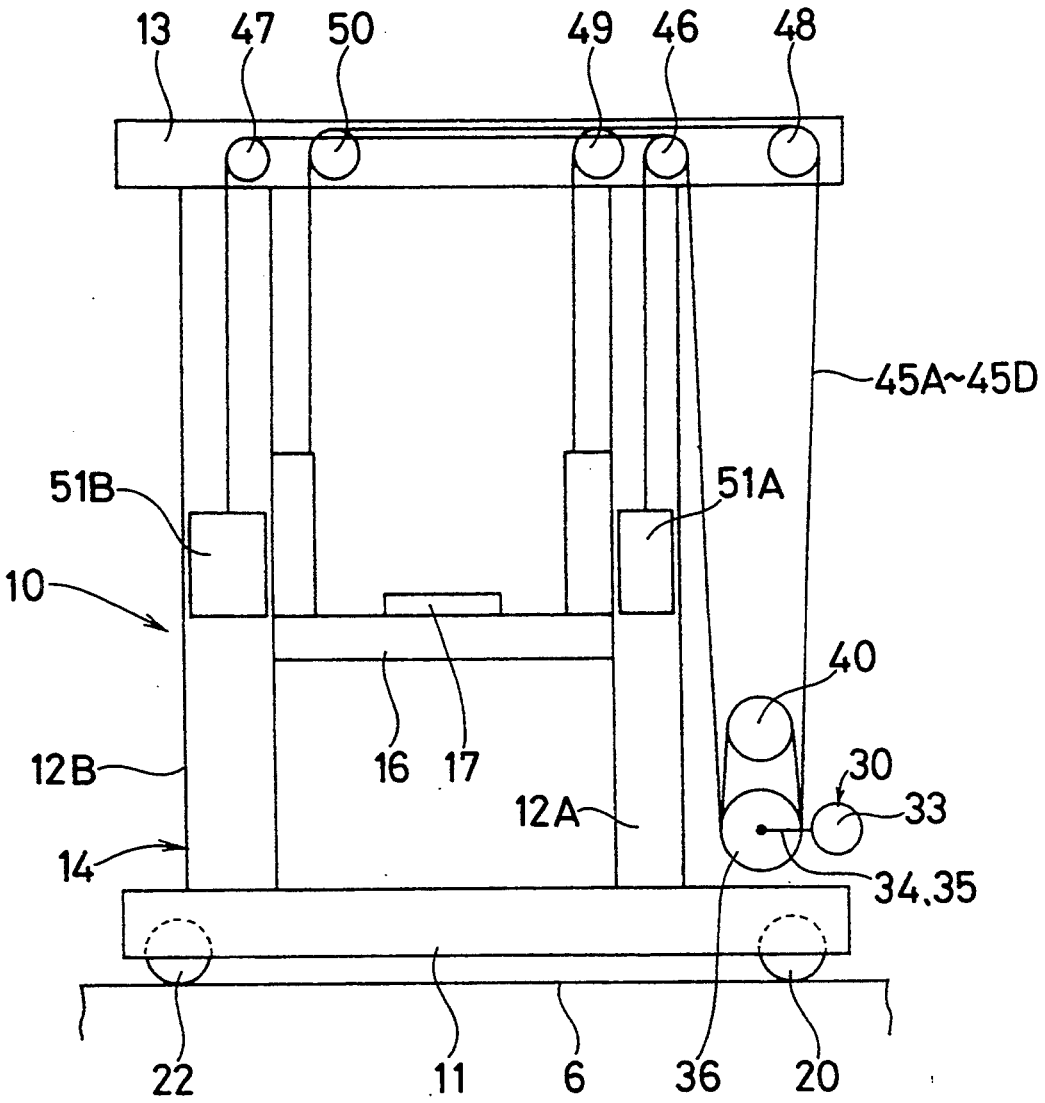
FIG. 10 is a schematic side view of a handling apparatus representing a second embodiment of the invention.
Figure 11:
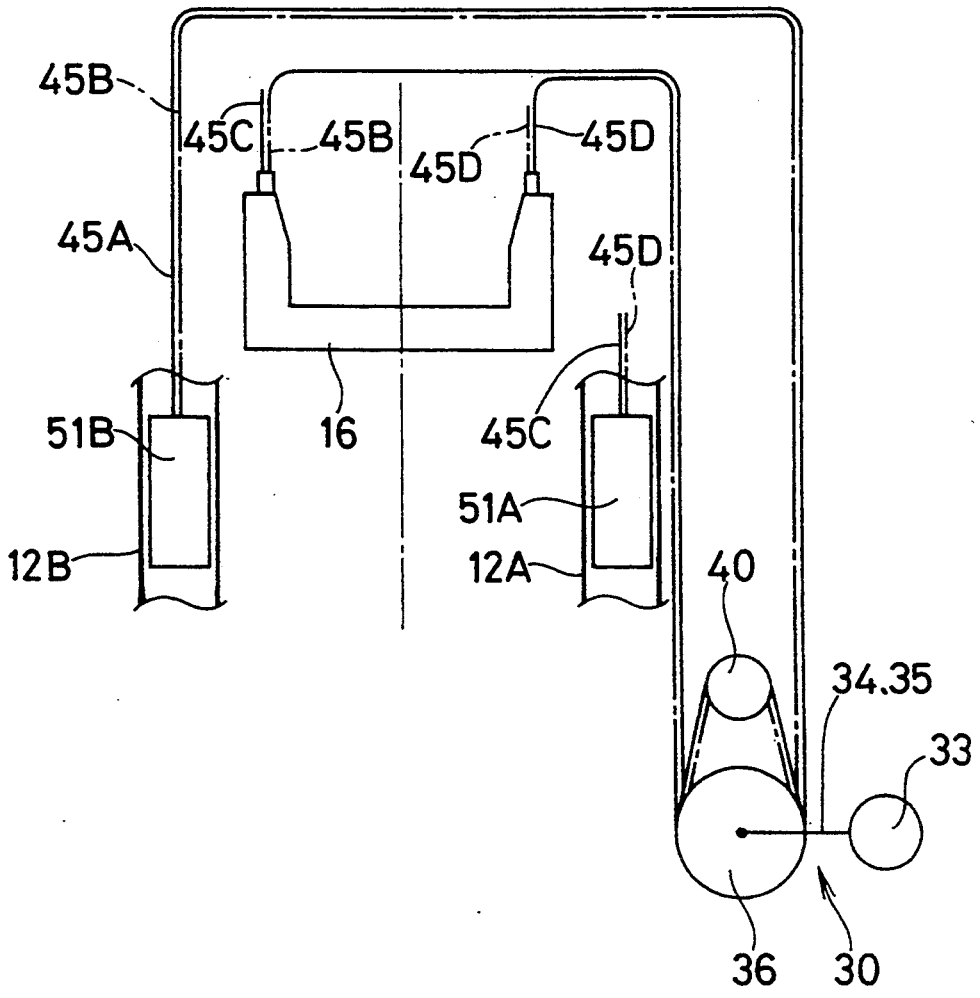
FIG. 11 is a schematic side view showing the condition of wires in their run in a third embodiment of the invention.
Figure 12:
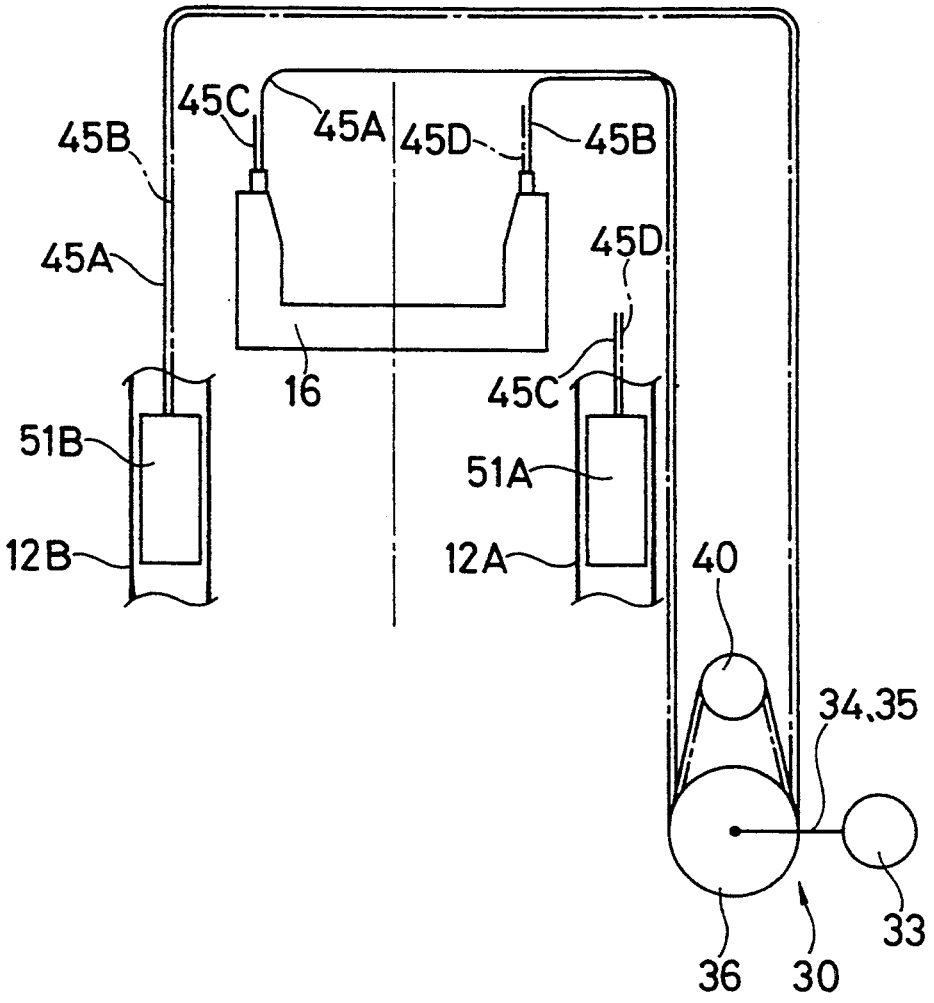
FIG. 12 is a schematic side view showing the condition of wires in their run in a fourth embodiment of the invention.
Figure 13:
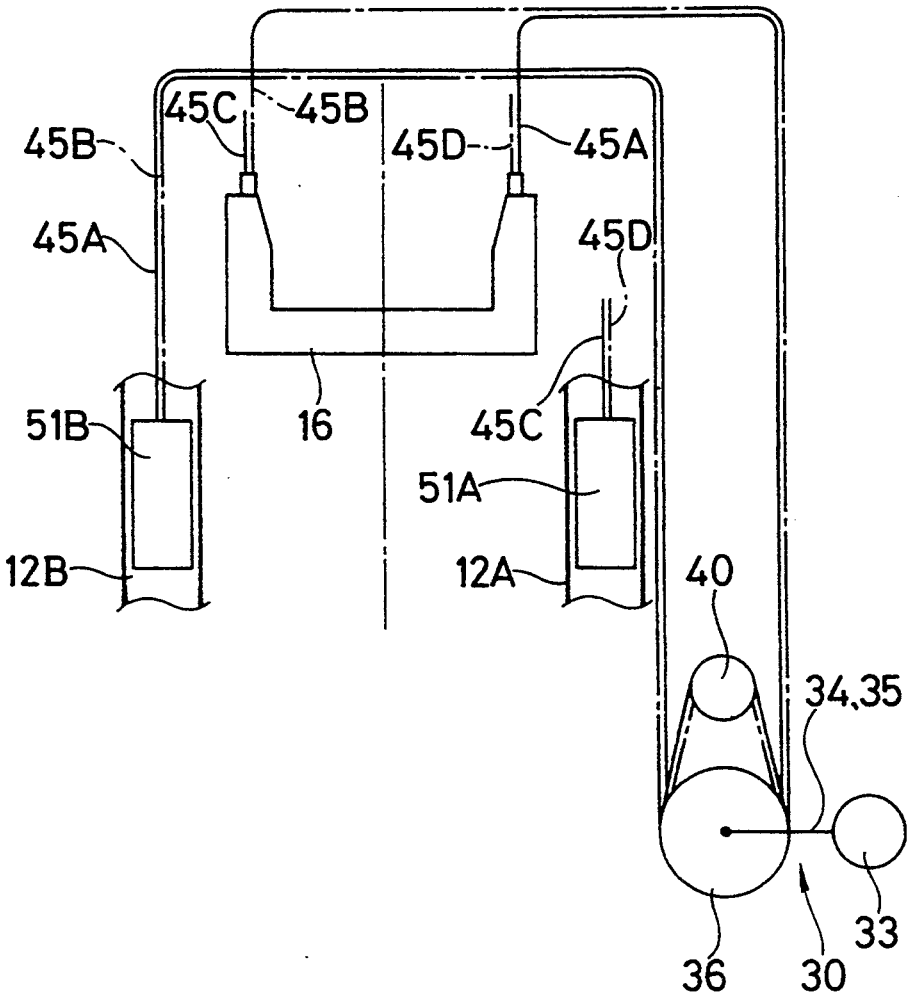
FIG. 13 is a schematic side view showing the condition of wires in their run in a fifth embodiment of the invention.
Figure 14:
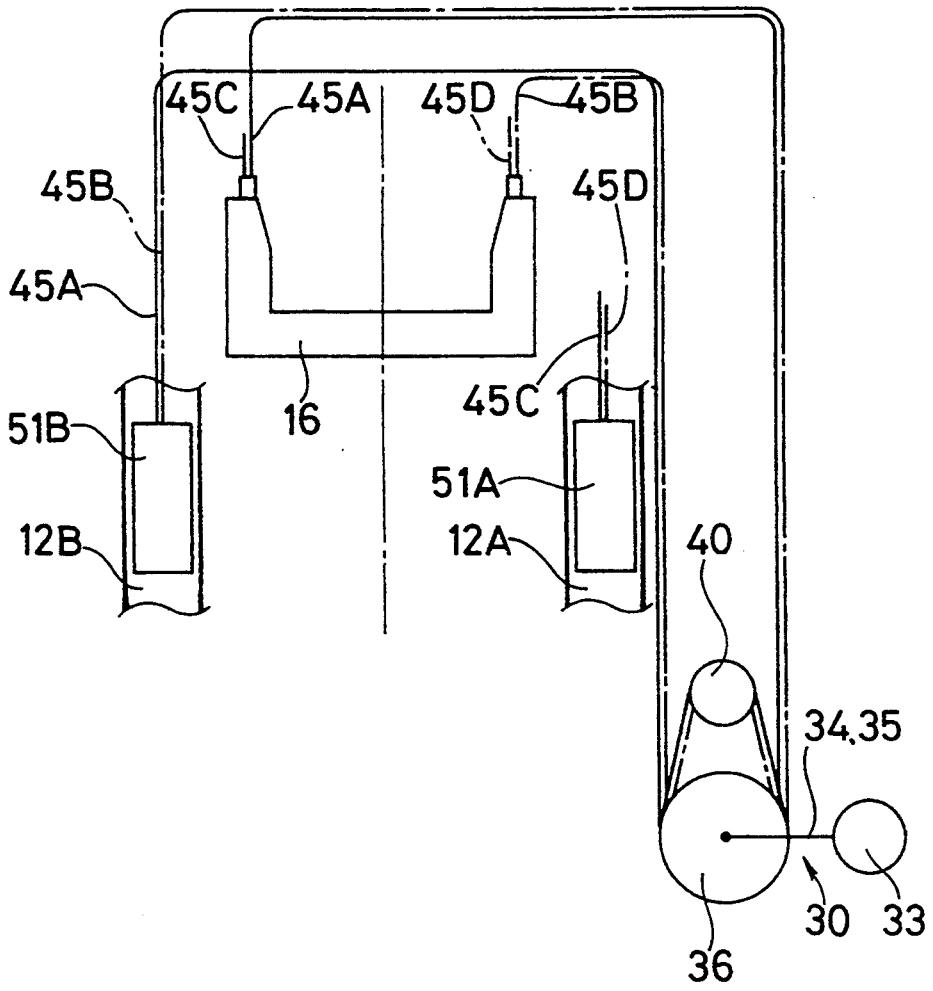
FIG. 14 is a schematic side view showing the condition of wires in their run in a sixth embodiment of the invention.

FIG. 10 shows a second embodiment of the invention. Support posts 12A, 12B are of such configuration that the post 12B located remote from the vertical run drive unit 30 is larger in cross sectional area than the post 12A located close to the unit 30. Further, counterweights 51A, 51B disposed within the posts 12A, 12B are so configured that the counterweight 51B away from the vertical run drive unit 30 is larger in weight depending upon the cross-sectional shape of the posts 12A, 12B (though same in height). In this way, the counterweight 51B remote from the vertical run drive unit 30 is sized larger in order to cope with an increase in weight of the second and third wires 45B, 45C made longer as they are positioned remote from the unit 30. Thus, stable upward and downward movement of the carriage 16 can be assured.

FIGS. 11 to 14 show modified forms of the first embodiment which represent third to sixth embodiments in which wire run for wires 45A to 45D is varied.

Figure 15:
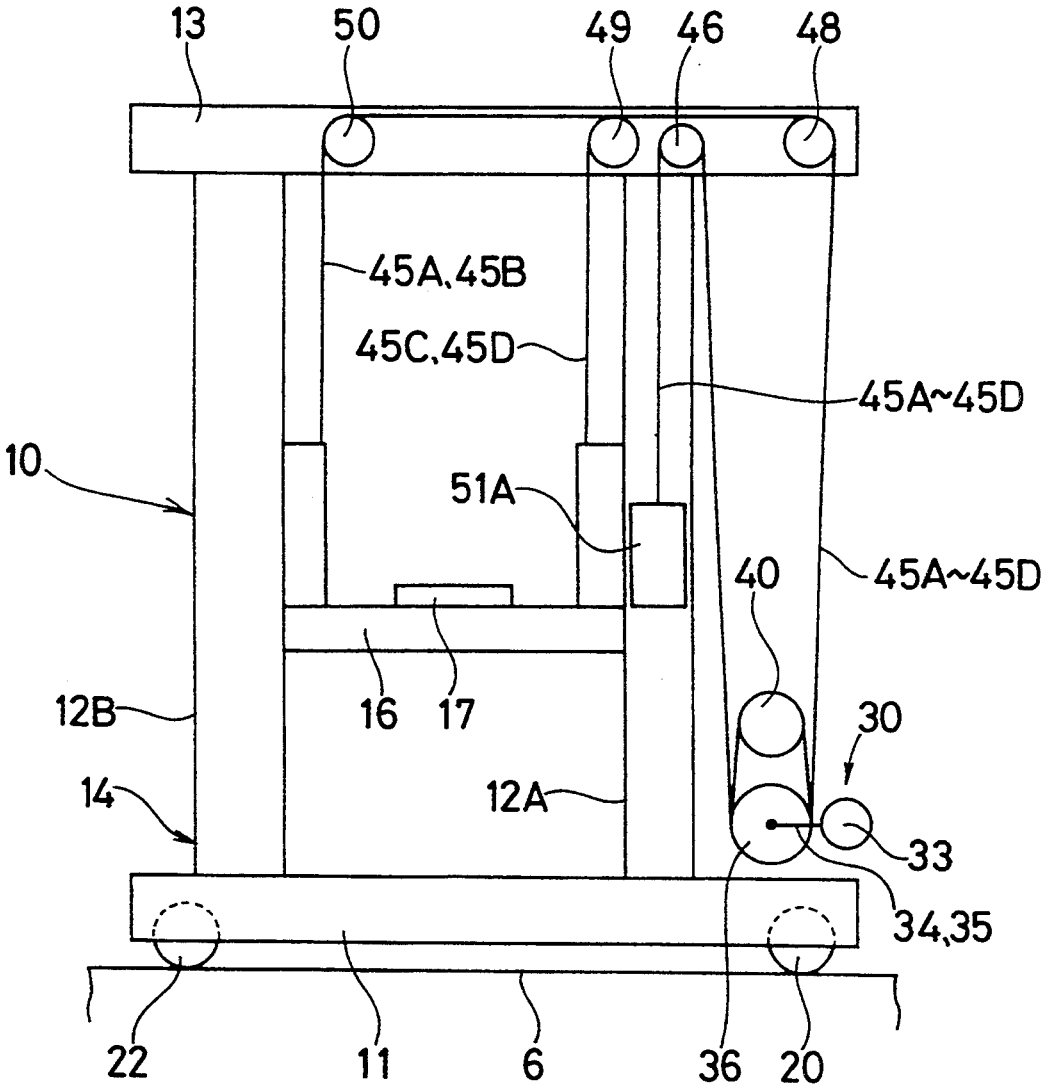
FIG. 15 is a schematic side view of a handling apparatus representing a seventh arrangement of the invention.

FIG. 15 shows a seventh embodiment of the invention. The other end portions of four wires located on the support 12A side are passed oved the first guide sheave 46 on the upper frame 13 and then received into the support post 12A in which they are connected to a common counterweight 51A disposed vertically movably therein. One side portions of four wires 45A to 45D positioned remote from the post 12A are passed over the third guide sheave 48 on the upper frame 13 and longitudinally extend within the upper frame 13 until they are trained about the fourth guide sheave 49 and fifth guide sheave 50, whereupon they are separated into groups of two wires each and connected to the top of the carriage 16 in spaced apart relation.

Figure 16:
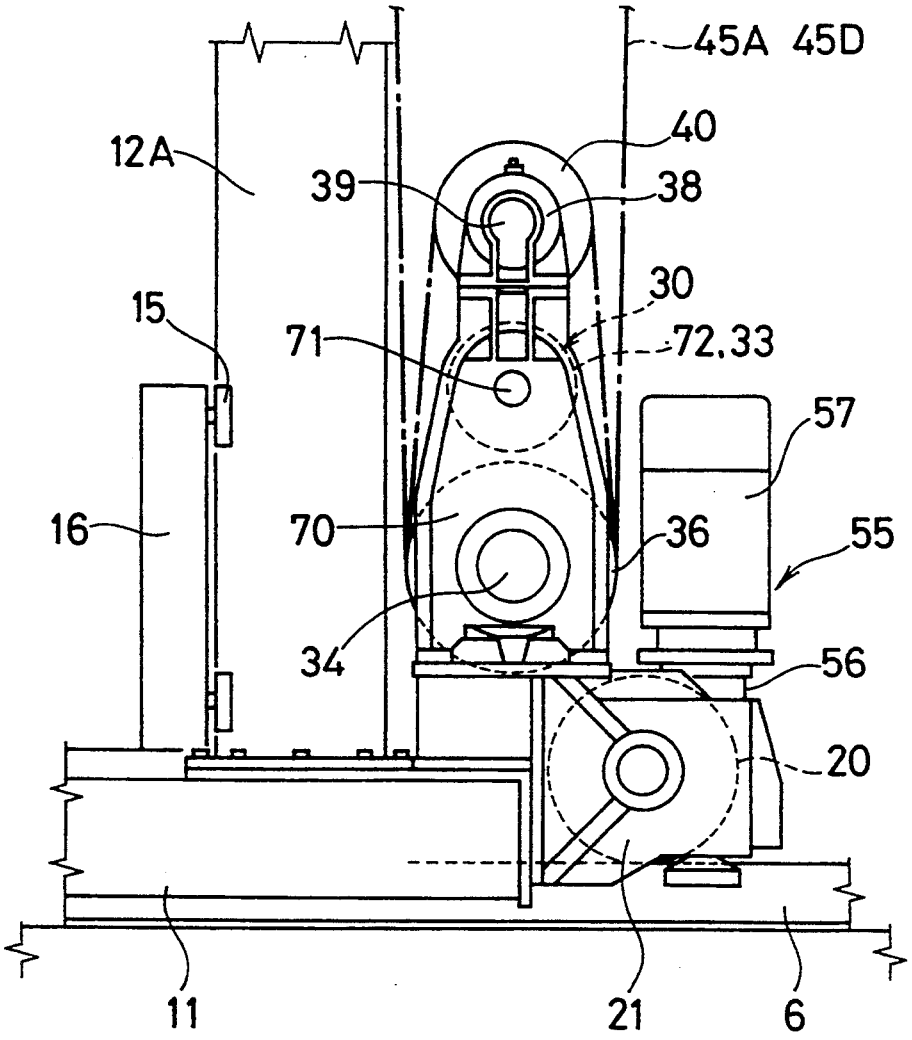
FIG. 16 is a side view of a vertical run drive unit portion representing an eighth embodiment of the invention.
Figure 17:
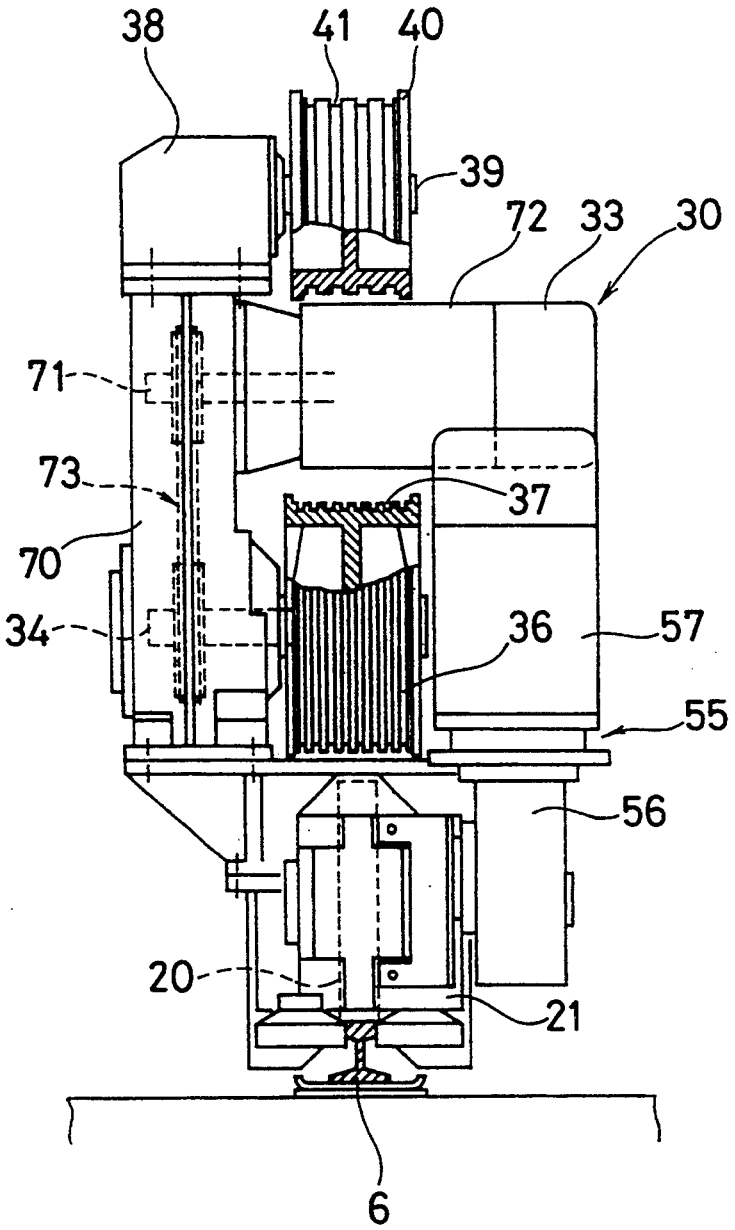
FIG. 17 is a front view of the vertical run drive unit portion.

FIGS. 16 and 17 show an eighth embodiment of the invention. The vertical run drive unit 30 has a transmission case 70 extending upward from one side of the support frame 21. On the other side upper surface of the transmission case 70 there is fixedly mounted a reduction gear 72 having an output shaft 71 extending in transverse directions within the transmission case 70. The reduction gear 72 has a drive mechanism 33 integrally geared thereto. A pair of sheaves 36, 40 are disposed in vertically spaced relation with the drive mechanism 33 being located between them.

Below the transmission case 70 is disposed a drive shaft 34 parallel to the output shaft 71, the drive shaft 71 being interlockingly connected to the output shaft 71 via a wrapping transmission gear 73 disposed in the transmission case 70. A drive sheave 36 is fixed to a projection of the drive shaft 34. A bearing device 38 is fixed to the top of the transmission case 70. A follower sheave 40 is fixed to a rotary shaft 39 supported by the bearing device 38.

According to this eighth embodiment, the drive mechanism 33 can be compactly disposed utilizing a space between the sheaves 36 and 40.

Figure 18:
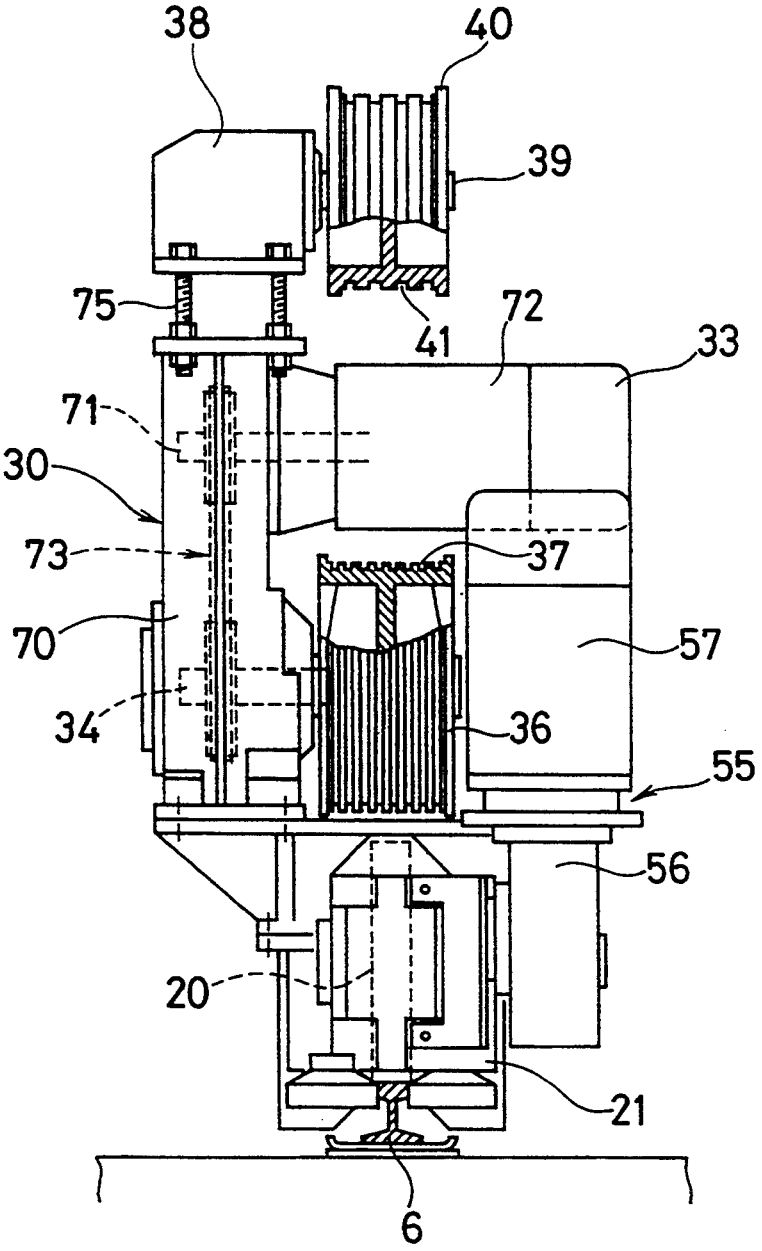
FIG. 18 is front view of a vertical run drive unit portion representing a ninth embodiment of the invention.

FIG. 18 shows a ninth embodiment of the invention. In the previously described eighth embodiment, the transmission case 70 and the bearing device 38 are interconnected by a position-adjustable fastener element 75 of the bolt and nut type. According to this embodiment, by vertically adjusting the position of the bearing device 38 relative to the transmission case 70 by manipulating the fastener element 75 it is possible to vertically displace the follower sheave 40 relative to the drive sheave 36, thereby to absorb any elongation of the wires 45A to 45D according to the variation in wire length between the sheaves 36 and 40.

The method of absorbing the elongation of wires 45A to 45D showin in the ninth embodiment is applicable to the foregoing first to seventh embodiments as well. For adjustment for elongation absorption purposes, besides the above mentioned bolt and nut type, various types of construction may be employed, including use of a shim and a screw shaft. In the ninth embodiment, the upper follower sheave 40 is vertically movable relative to the drive sheave 36. Alternatively, the lower sheave, i.e., drive sheave 36 may be made vertically movable relative to the follower sheave 40; or both sheaves 36, 40 may be made vertically movable.

Figure 19:
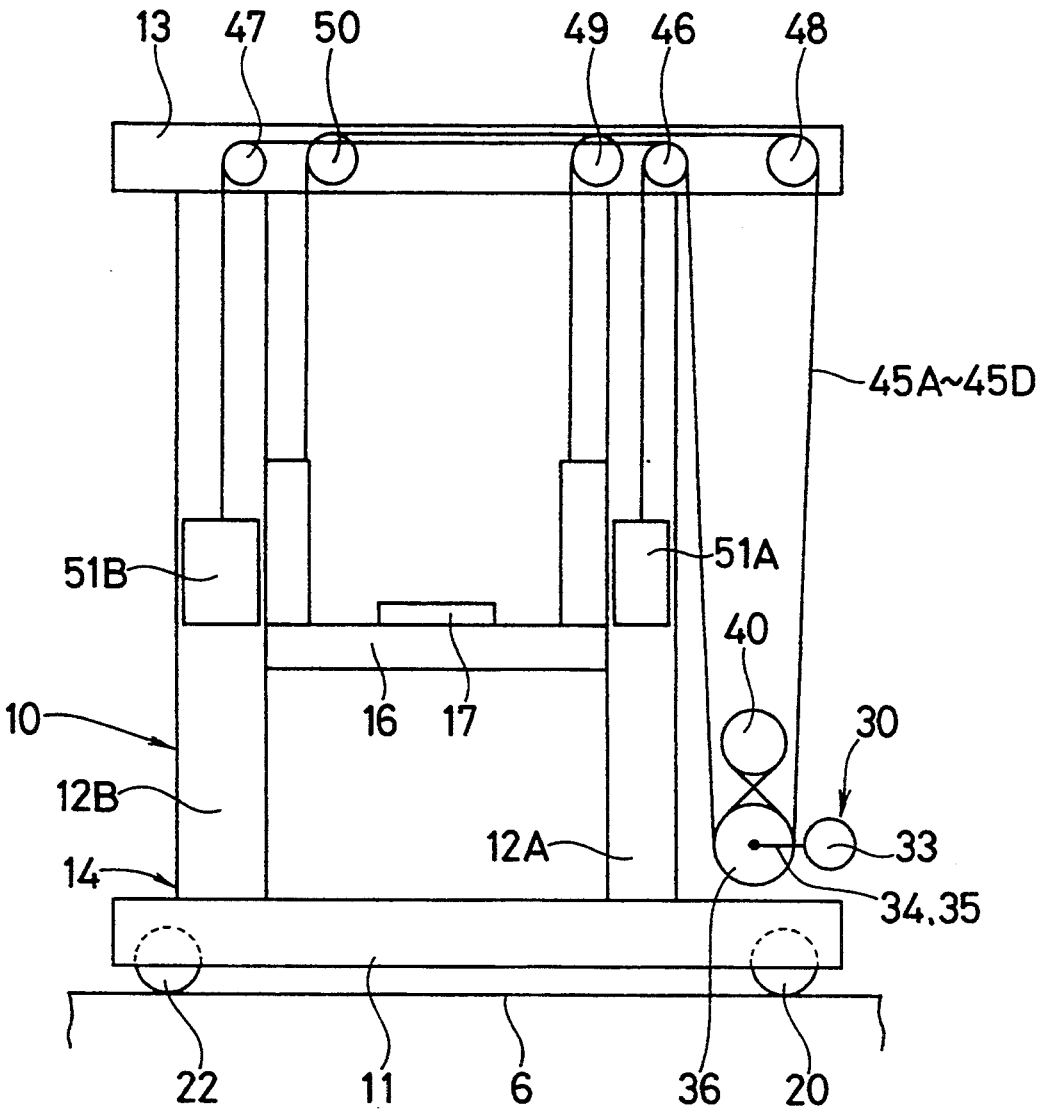
FIG. 19 is a schematic side view of a vertical run drive unit portion representing a tenth embodiment of the invention.

FIG. 19 shows a tenth embodiment of the invention. Wires 45A to 45D are trained between a pair of sheaves 36 and 40 in cross pattern (8 pattern). According to this embodiment, the length of engagement of wires 45A to 45D with the two sheaves 36, 40 can be made longer and accordingly increased force of friction can be obtained.

In the foregoing embodiments, the drive mechanism 33 is interlockingly connected to the lower sheave, but alternatively the drive mechanism 33 may be interlockingly connected to an upper sheave which acts as a drive sheave.

What is claimed is:

1. A handling apparatus comprising:

a traveling body including a lower framer a support post extending upwardly from the lower frame, and an upper frame mounted on top of the support post;

an upward and downward movable carriage mounted on one side of the post as viewed in the direction of movement of the traveling body;

a vertical run drive unit mounted on the other side of the post for driving the carriage to move upward and downward;

said vertical run drive unit including a pair of sheaves arranged in vertically spaced relation and having shafts extending in a direction traversing said moving direction of said traveling body;

said vertical run drive unit further including a vertical run drive mechanism disposed on a side of said sheaves opposite to a side on which said sheaves are disposed adjacent to said post, said vertical run drive mechanism being interlockingly connected to one of the sheaves; and a wire passed over the upper one of the sheaves and trained about the lower sheave from opposite directions, the wire being connected at one end to the carriage, the other end of the wire being connected to a counterweight.

2. A handling apparatus as set forth in claim 1, wherein the wire passed over the upper sheave and trained about the lower sheave from opposite directions is provided in two sets, the two sets of wires being respectively passed at both ends over guide sheaves provided on the upper frame and then connected at one end to the carriage in spaced relation in the direction of movement of the traveling body, the other ends of the wires being connected to the counterweight.

3. A handling apparatus as set forth in claim 1, wherein the vertical run drive unit comprises a frame member provided on the lower frame side, said pair of sheaves being mounted to the frame member in a cantilever fashion, and a vertical run drive mechanism interlockingly connected to one of the sheaves.

4. A handling apparatus as set forth in claim 1, wherein the wire is trained about the pair of vertically spaced sheaves in a given direction of winding.

5. A handling apparatus as set forth in claim 1, wherein the support post is of a hollow construction and has the counterweight vertically movably disposed therein.

6. A handling apparatus as set forth in claim 1, wherein at least one of the pair of vertically spaced sheaves is movable toward and away from the other sheave.

7. A handling apparatus as set forth in claim 1, wherein the wire is trained about the pair of vertically spaced sheaves in a cross pattern.

8. A handling apparatus comprising:

a traveling body including a lower frame, a support post extending upwardly from the lower frame, and an upper frame mounted on top of the support post;

an upward and downward movable carriage mounted on one side of the post as viewed in the direction of movement of the traveling body;

a vertical run drive unit mounted on the other side of the post for driving the carriage to move upward and downward;

said vertical run drive unit including a pair of sheaves arranged in vertically spaced relation and having shafts extending in a direction traversing said moving direction of said traveling body;

said vertical run drive unit further including a vertical run drive mechanism disposed between said sheaves, said vertical run drive mechanism being interlockingly connected to one of the sheaves; and a wire passed over the upper one of the sheaves and trained about the lower sheave from opposite directions, the wire being connected at one end to the carriage, the other end of the wire being connected to a counterweight.

9. A handling apparatus comprising:

a traveling body including a lower frame, a pair of support posts extending upwardly from the lower frame in respective positions spaced apart from each other in a moving direction of said traveling body, and an upper frame mounted on and between tops of the support posts;

an upward and downward movable carriage mounted between the two support posts;

a vertical run drive unit for driving said carriage in vertical directions, said vertical run drive unit being mounted on a side of one of said two support posts opposite to a side on which said carriage is disposed;

said vertical run drive unit including a pair of sheaves arranged in vertically spaced relation and having shafts extending in a direction traversing said moving direction of said traveling body;

said vertical run drive unit further including a vertical run drive mechanism disposed on a side of said sheaves opposite to a side on which said sheaves are disposed adjacent to said one of said posts, said vertical run drive mechanism being interlockingly connected to one of the sheaves; and two sets of wires passed over the upper one of the sheaves and trained about the lower sheave from opposite directions, the wires being passed over a plurality of guide sheaves provided on said upper frame, each of a first set of wires being connected at one end to said carriage and at the other end to a first counterweight and each of a second set of wires being connected at one end to said carriage and at other end to a second counterweight such that, in said moving direction of said traveling body, a point at which said each of said first set of wires is connected at said one end to said carriage is disposed opposite to a point at which said each of said second set of wires is connected at said one end to said carriage.

10. A handling apparatus as set forth in claim 9, wherein the vertical run drive unit comprises a frame member provided on the lower frame side, said pair of sheaves being mounted to the frame member in a cantilever fashion.

11. A handling apparatus as set forth in claim 9, wherein the two sets of wires are trained about the pair of vertically spaced sheaves in a given direction of winding.

12. A handling apparatus as set forth in claim 9, wherein the support posts are of a hollow construction and have the respective counterweights vertically movably disposed therein.

13. A handling apparatus as set forth in claim 12, wherein four wires are trained about the lower sheave from opposite directions, the wires being passed at both ends over said guide sheaves provided on the upper frame, first and second ones of the wires being connected at one end to one side of the carriage, third and fourth ones of the wires being connected at one end to the other side of the carriage disposed opposite to said one side of said carriage in said moving direction of said traveling body, said first and fourth wires being connected at the other end to said first counterweight disposed within one support post, and second and third wires being connected at the other end to said second counterweight disposed within the other support post.

14. A handling apparatus as set forth in claim 9, wherein at least one of the pair of vertically spaced sheaves is movable toward and away from the other sheave.

15. A handling apparatus as set forth in claim 9, wherein the two sets of wires are trained about the pair of vertically spaced sheaves in a cross pattern.

16. A handling apparatus comprising:

a traveling body including a lower frame, a pair of support posts extending upwardly from the lower frame in respective positions spaced apart from each other in a moving direction of said traveling body, and an upper frame mounted on and between tops of the support posts;

an upward and downward movable carriage mounted between the two support posts;

a vertical run drive unit for driving said carriage in vertical directions, said vertical run drive unit being mounted on a side of one of said two support posts opposite to a side on which said carriage is disposed;

said vertical run drive unit including a pair of sheaves arranged in vertically spaced relation and having shafts extending in a direction traversing said moving direction of said traveling body;

said vertical run drive unit further including a vertical run drive mechanism disposed between said sheaves, said vertical run drive mechanism being interlockingly connected to one of the sheaves; and two sets of wires passed over the upper one of the sheaves and trained about the lower sheave from opposite directions, the wires being passed over a plurality of guide sheaves provided on said upper frame, each of a first set of wires being connected at one end to said carriage and at other end to a first counterweight and each of a second set of wires being connected at one end to said carriage and at other end to a second counterweight such that, in said moving direction of said traveling body, a point at which said each of said first set of wires is connected at said one end to said carriage is disposed opposite to a point at which said each of said second set of wires is connected at said one end to said carriage.

17. A handling apparatus comprising:

a traveling body including a lower frame and a support post extending upwardly from the lower frame;

an upward and downward movable carriage mounted on one side of the post as viewed in the direction of movement of the traveling body;

a vertical run drive unit mounted on the other side of the post for driving the carriage to move upward and downward;

said vertical run drive unit including a drive sheave disposed in a cantilever fashion in a widthwise center portion of the traveling body and having a shaft extending in a direction traversing said moving direction of said traveling body;

said vertical run drive unit further including a vertical run drive mechanism interlockingly connected to the drive sheave and disposed at one side of the traveling body as viewed widthwise thereof;

a horizontal run drive unit for driving the traveling body which is disposed at the other side of the traveling body and in opposed relation to the vertical run drive unit;

a power control unit for horizontal and vertical run, said power control unit being disposed adjacent to said horizontal run drive unit in said moving direction of said traveling body; and a wire passed over the drive sheave, one end of the wire being connected to the carriage, the other end of the wire being connected to a counterweight.

18. A handling apparatus as set forth in claim 17, wherein a pair of sheaves are arranged in a cantilever fashion at a location central widthwise of the traveling body, and wherein the vertical run drive mechanism is interlockingly connected to one of the pair of sheaves, with a wire being trained between the pair of sheaves.

19. A handling apparatus as set forth in claim 17, wherein the vertical run afire mechanism and the horizontal run drive unit are longitudinally arranged.

20. A handling apparatus as set forth in claim 17, wherein a power supply unit is mounted on the lower frame at a location beneath the power control unit for horizontal and vertical run.

21. A handling apparatus comprising:

a traveling body including a lower frame and a support post extending upwardly from the lower frame;

an upward and downward movable carriage mounted on one side of the post as viewed in the direction of movement of the traveling body;

a vertical run drive unit for driving the carriage to move upward and downward and a horizontal run drive unit for driving the traveling body to run, both drive units mounted on the other side of the post;

said vertical run drive unit including a drive sheave disposed in a widthwise center portion of the traveling body, and having a shaft extending in a direction traversing said moving direction of said traveling body;

a power control unit for the horizontal run and the vertical run mounted on the traveling body at such a position as to cover the drive sheave from a side facing in said direction traversing said moving direction of said traveling body.

* * * * *